US011767648B2

(12) United States Patent
Champagne

(10) Patent No.: US 11,767,648 B2
(45) Date of Patent: Sep. 26, 2023

(54) SOUND BARRIER

(71) Applicant: CHAMPAGNE EDITION INC., Sturgeon County (CA)

(72) Inventor: Alan Rolland Champagne, Sturgeon County (CA)

(73) Assignee: Champagne Edition Inc., Sturgeon County (CA)

( * ) Notice: Subject to any disclaimer, the term of this patent is extended or adjusted under 35 U.S.C. 154(b) by 359 days.

(21) Appl. No.: 17/082,585

(22) Filed: Oct. 28, 2020

(65) Prior Publication Data

US 2021/0131049 A1 May 6, 2021

Related U.S. Application Data

(60) Provisional application No. 62/931,592, filed on Nov. 6, 2019.

(51) Int. Cl.

| | |
|---|---|
| ***E01F 8/00*** | (2006.01) |
| ***E04B 1/86*** | (2006.01) |
| *E04B 1/82* | (2006.01) |

(52) U.S. Cl.

CPC ..... *E01F 8/0017* (2013.01); *E01F 8/0023* (2013.01); *E04B 1/86* (2013.01); *E04B 2001/8263* (2013.01)

(58) Field of Classification Search

CPC ..... E01F 8/0017; E01F 8/0023; E01F 8/0005; E01F 8/0035; E04B 1/86; E04B 1/82; E04B 1/84; E04B 1/8409; E04B 2001/8414; E04B 2001/8263

See application file for complete search history.

(56) References Cited

U.S. PATENT DOCUMENTS

| | | | | | |
|---|---|---|---|---|---|
| 5,067,296 | A * | 11/1991 | Brown | E04C 2/386 | 52/794.1 |
| 5,136,821 | A * | 8/1992 | Child | E01F 8/0058 | 52/169.4 |
| 5,272,284 | A * | 12/1993 | Schmanski | E01F 8/0023 | 181/290 |
| 5,406,039 | A * | 4/1995 | Rerup | E01F 8/0017 | 181/294 |
| 5,426,267 | A * | 6/1995 | Underhill | E01F 8/0011 | 181/290 |
| 5,438,171 | A * | 8/1995 | Schmanski | B29C 70/525 | 52/145 |

(Continued)

FOREIGN PATENT DOCUMENTS

| | | | | |
|---|---|---|---|---|
| CA | 2015765 | A1 * | 10/1991 | E01F 15/00 |
| DE | 19938676 | A1 * | 2/2001 | E01F 8/0017 |

(Continued)

*Primary Examiner* — Edgardo San Martin
(74) *Attorney, Agent, or Firm* — Kirsten M. Oates; Rodman & Rodman LLP

(57) ABSTRACT

A sound barrier includes panels comprising a polymeric material and reinforcing inserts encased within the polymeric material; and a frame comprising posts positioned in spaced, parallel relationship and extending vertically upward, and defining inwardly-facing slots for receiving the panels. The panels are mounted lengthwise with ends within the slots and adjacent panels engage each other by tongues and grooves of lateral surfaces. Methods of making the sound barrier are provided.

12 Claims, 10 Drawing Sheets

(56) References Cited

U.S. PATENT DOCUMENTS

| | | | | | |
|---|---|---|---|---|---|
| 5,943,775 | A * | 8/1999 | Lanahan | B26D 1/553 | 52/592.1 |
| 7,343,715 | B2 * | 3/2008 | Ito | E01F 8/007 | 428/56 |
| 7,478,797 | B2 * | 1/2009 | Laws | E04H 17/168 | 52/316 |
| 8,051,950 | B2 * | 11/2011 | Alston | G10K 11/165 | 181/290 |
| 8,561,371 | B2 * | 10/2013 | Sanders | E04B 1/14 | 52/764 |
| 8,826,617 | B2 * | 9/2014 | Endo | E04C 2/296 | 428/36.5 |
| 10,221,529 | B1 * | 3/2019 | Sanders | H02G 3/386 | |
| 10,422,156 | B1 * | 9/2019 | Morrow | E04H 17/22 | |
| D884,925 | S * | 5/2020 | Rue | D25/138 | |
| 11,479,931 | B2 * | 10/2022 | Wilson | E01F 8/0011 | |
| 2006/0118354 | A1 * | 6/2006 | Corbin | B64F 1/26 | 181/210 |
| 2011/0047912 | A1 * | 3/2011 | Armijo | E04B 1/14 | 52/309.4 |
| 2012/0325579 | A1 * | 12/2012 | Smith | E01F 8/0029 | 181/294 |
| 2018/0137850 | A1 * | 5/2018 | Harrison | G10K 11/168 | |
| 2019/0013002 | A1 * | 1/2019 | Succi | B32B 3/06 | |
| 2021/0131049 | A1 * | 5/2021 | Champagne | E04B 1/86 | |

FOREIGN PATENT DOCUMENTS

| | | | | |
|---|---|---|---|---|
| EP | 0728877 | A1 * | 8/1996 | E04B 1/86 |
| KR | 20100129154 | A * | 12/2010 | E04F 15/20 |
| KR | 102347206 | B1 * | 1/2022 | G10K 11/162 |
| WO | WO-2013027219 | A1 * | 2/2013 | B29C 43/003 |
| WO | WO-2018024263 | A1 * | 2/2018 | E01B 19/00 |

* cited by examiner

Stress in Thermoplastic Resin

Deflection/
Sound
Transmission
Class STC

STC = 29

TOTAL DEFICIENCIES = 26

Stress in Thermoplastic Resin

Deflection

Finite Element Analysis

SOUND BARRIER

CROSS-REFERENCE TO RELATED APPLICATION

This application claims priority to U.S. Provisional Application No. 62/931,592 filed Nov. 6, 2019, the content of which is hereby incorporated by reference in its entirety.

TECHNICAL FIELD

The present invention relates to a sound barrier comprising a plurality of reinforced sound-absorbing panels mounted within a frame, and methods of making the sound barrier.

BACKGROUND

The need to reduce sound especially in residential, industrial, or construction areas can be challenging. Noise pollution affects both health and behavior, and can cause hypertension, high stress level, tinnitus, hearing loss, speech interference, damage to psychological health, and other harmful effects to workers and residents in the vicinity. It is thus desirable to minimize, or at least reduce, the amount of sound which is generated.

Various approaches to noise control have included for example, sound blankets, acoustical panels, curtains, baffles, enclosures, fences, and walls constructed of cloth, quilts, vinyl, foam, composites, wood, steel, metal, concrete, cement board, and other materials. However, each has various disadvantages that make widespread production and installation impractical, either due to cost, manufacture or installation complexity. Wood barriers may be lightweight, but are largely ineffective in preventing sound transmission and subject to constant wear from exposure to the environment. Heavy steel and metal barriers are expensive and prone to corrosion. Concrete barriers may also be costly to manufacture, difficult to install, and tend to reflect sounds waves due to being solid. Such barriers may not be aesthetically pleasing or provide limited sound attenuation. Sound attenuation is the combined effect of scattering and absorption that, together, control sound. Scattering is the reflection of sound in directions other than the original direction of propagation of the sound. Absorption is the conversion of sound energy into other forms of energy. Accordingly, there is a need in the art for an improved apparatus and method which mitigate these problems and are capable of providing sound attenuation.

SUMMARY OF THE INVENTION

The present invention relates to a sound barrier comprising a plurality of reinforced sound-absorbing panels mounted within a frame, and methods of making the sound barrier.

In one aspect, the present invention comprises a sound barrier comprising:

a plurality of panels, each panel comprising a polymeric material and a plurality of reinforcing inserts encased within the polymeric material; and a frame comprising a plurality of posts positioned in spaced, parallel relationship and extending vertically upward, and defining inwardly-facing slots for receiving the panels;

wherein the panels are mounted lengthwise with ends within the slots and adjacent panels engage each other by tongues and grooves of lateral surfaces.

In some embodiments, the polymeric material comprises rubber from recycled tires or tire-derived fiber from recycled tires in the form of particulate crumb sized to confer density hardness to the panels.

In some embodiments, the panel has a substantially rectangular shape comprising opposing upper and lower major surfaces textured in the form of a brick-like mosaic or stone pattern; opposing end surfaces configured for insertion into the slots of the posts; a first lateral surface defining a tongue extending along a length of the first lateral surface; and a second lateral surface defining a groove extending along a length of the second lateral surface.

In some embodiments, the reinforcing inserts are oriented to extend between the opposing end surfaces along an entire length or a portion thereof of the panel, each insert being spaced parallel and apart from adjacent inserts.

In some embodiments, the reinforcing inserts are formed of wood or a composite material.

In some embodiments, a plurality of brackets is secured within the slots at bases of the posts for supporting the panels above ground.

In some embodiments, the barrier further comprises a cross-beam received within the slots of the posts and seating against the brackets, the cross-beam being oriented perpendicularly to bases of the posts and extending horizontally between the posts for supporting the panels thereabove.

In some embodiments, the barrier has a density hardness ranging from about 55 to about 63; a sound transmission class ranging between about 29 to about 37; and a noise reduction coefficient of at least 0.30.

In another aspect, the invention comprises a method for producing a sound barrier comprising the steps of:

a) forming a plurality of panels, each panel comprising a polymeric material and a plurality of reinforcing inserts encased within the polymeric material; and b) forming a frame comprising a plurality of posts defining inwardly-facing slots for receiving the panels.

In some embodiments, each panel is formed by:

i) placing a first portion of a polymeric material and a binder into a mold having a configuration of the panel, wherein the panel has a substantially rectangular shape comprising opposing upper and lower major surfaces textured in the form of a brick-like mosaic or stone pattern; opposing end surfaces configured for insertion into the slots of the posts; a first lateral surface defining a tongue extending along a length of the first lateral surface; and a second lateral surface defining a groove extending along a length of the second lateral surface;

ii) orienting reinforcing inserts to extend between the opposing end surfaces along an entire length or a portion thereof of the panel, each insert being spaced parallel and apart from adjacent inserts;

iii) encasing the reinforcing inserts with a second portion of the polymeric material and the binder;

iv) allowing the binder to cure while subjecting the polymeric material to pressure inside the mold.

In some embodiments, the polymeric material comprises crumb rubber from recycled tires, or tire-derived fiber from recycled tires.

In some embodiments, the binder is selected from polyurea or polyurethane polymer.

In some embodiments, the reinforcing inserts are formed of wood or a composite material.

In some embodiments, the method comprises subjecting the polymeric material to sufficient pressure inside the mold to yield a density hardness ranging from about 55 to about 63.

In some embodiments, the method further comprises securing a plurality of brackets within the slots at bases of the posts for supporting the panels above ground.

In some embodiments, the method further comprises inserting a cross-beam within the slots of the posts and seating the cross-beam against the brackets, the cross-beam being oriented perpendicularly to bases of the posts and extending horizontally between the posts for supporting the panels thereabove.

BRIEF DESCRIPTION OF THE DRAWINGS

Exemplary embodiments of the present invention are described with reference to the following drawings. In the drawings, like elements are assigned like reference numerals. The drawings are not necessarily to scale, with the emphasis instead placed upon the principles of the present invention. Additionally, each of the embodiments depicted is but one of a number of possible arrangements utilizing the fundamental concepts of the present invention. The drawings are briefly described as follows.

DETAILED DESCRIPTION OF THE INVENTION

Figure 1:
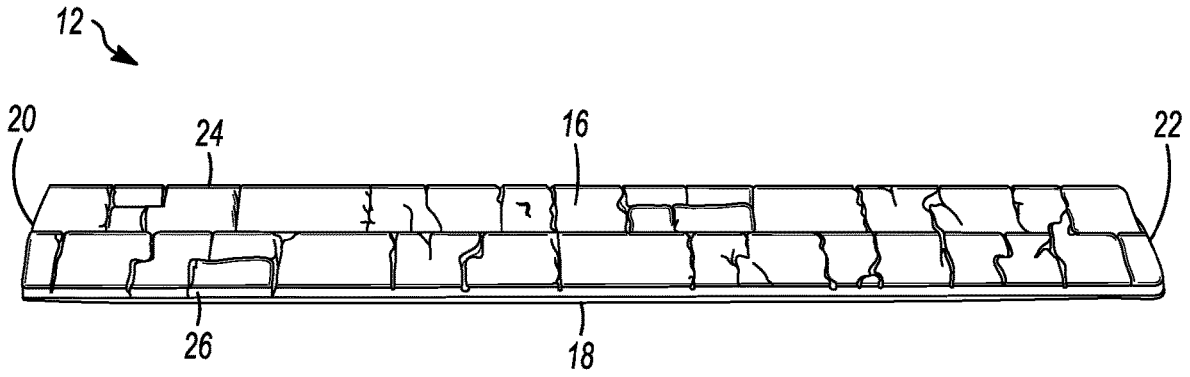
FIG. 1 is a top perspective view of a first embodiment of a sound-absorbing panel of the present invention.
Figure 2:
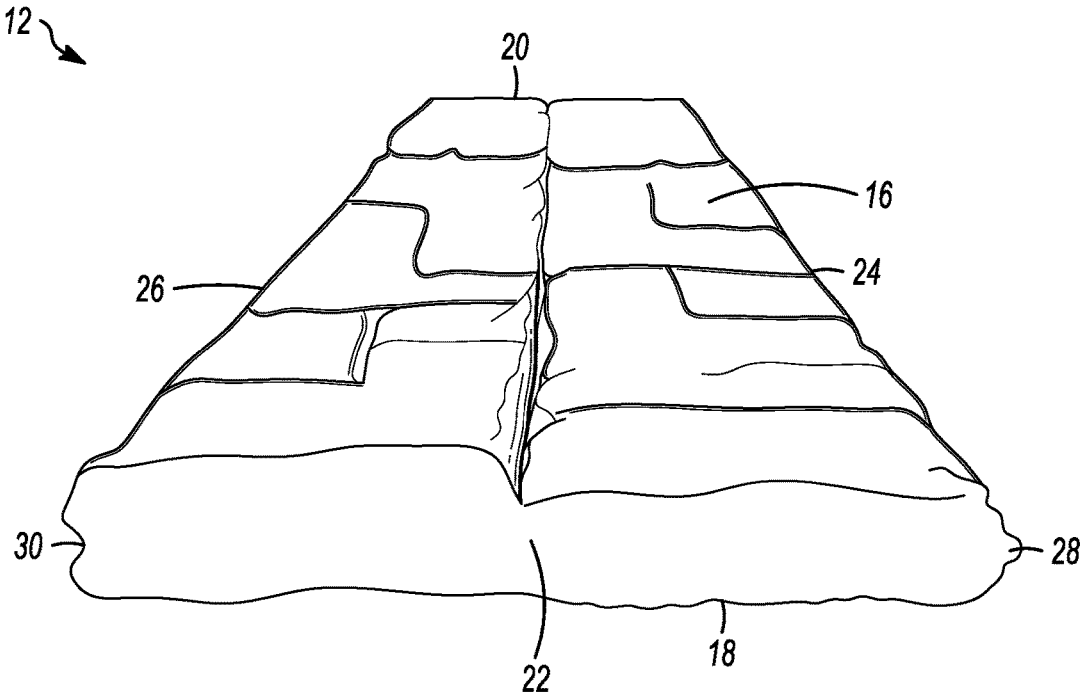
FIG. 2 is an end view of the panel of FIG. 1.
Figure 3:
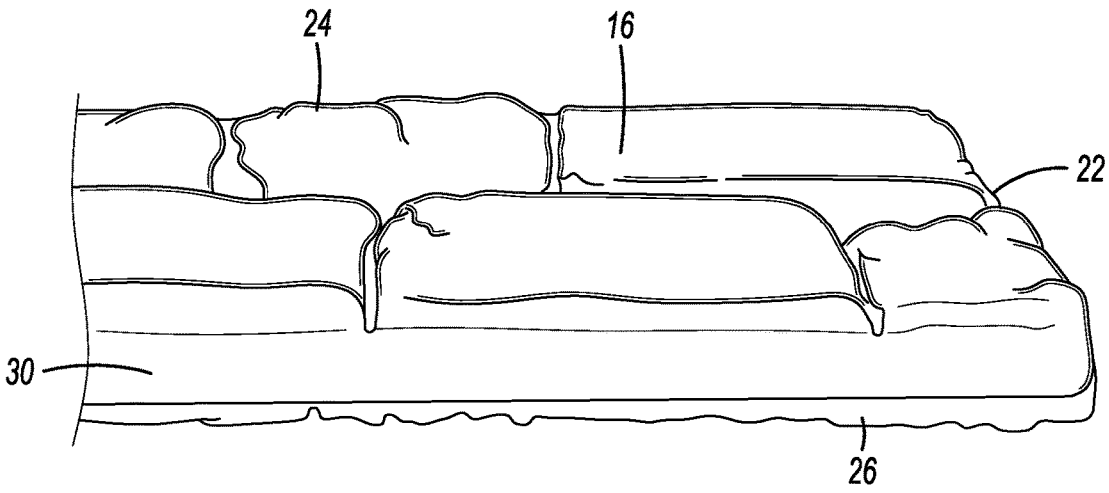
FIG. 3 is a side view of a portion of the panel of FIG. 1.
Figure 4:
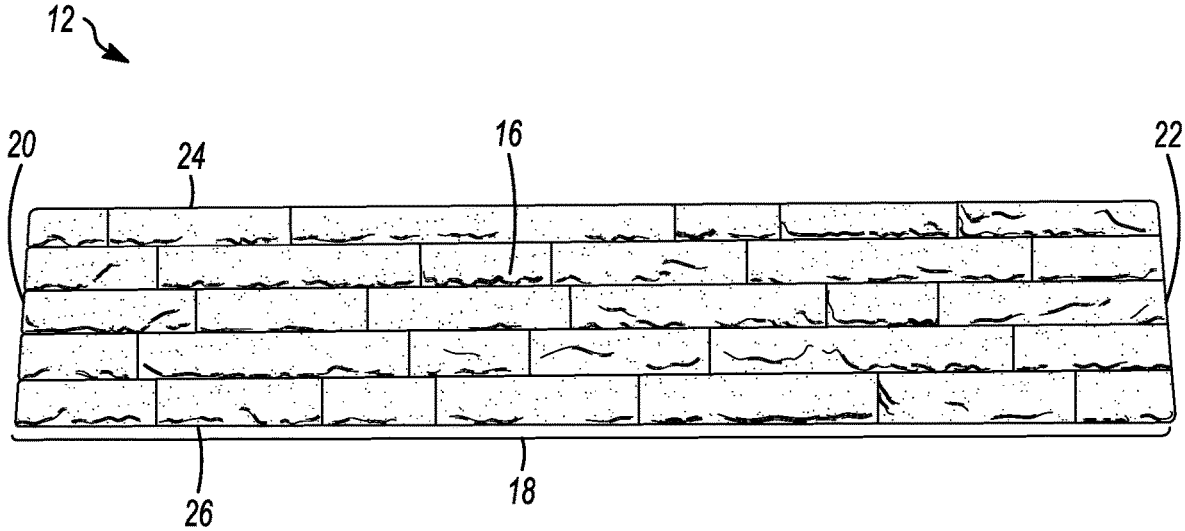
FIG. 4 is a top perspective view of a second embodiment of a sound-absorbing panel of the present invention.

Before the present invention is described in further detail, it is to be understood that the invention is not limited to the particular embodiments described, as such may, of course, vary. It is also to be understood that the terminology used herein is for the purpose of describing particular embodiments only, and is not intended to be limiting, since the scope of the present invention will be limited only by the appended claims.

Where a range of values is provided, it is understood that each intervening value, to the tenth of the unit of the lower limit unless the context clearly dictates otherwise, between the upper and lower limit of that range and any other stated or intervening value in that stated range is encompassed within the invention. The upper and lower limits of these smaller ranges may independently be included in the smaller ranges is also encompassed within the invention, subject to any specifically excluded limit in the stated range. Where the stated range includes one or both of the limits, ranges excluding either or both of those included limits are also included in the invention.

Unless defined otherwise, all technical and scientific terms used herein have the same meaning as commonly understood by one of ordinary skill in the art to which this invention belongs. Although any methods and materials similar or equivalent to those described herein can also be used in the practice or testing of the present invention, a limited number of the exemplary methods and materials are described herein.

It must be noted that as used herein and in the appended claims, the singular forms "a", "an", and "the" include plural referents unless the context clearly dictates otherwise.

The present invention relates to a sound barrier comprising a plurality of reinforced sound-absorbing panels mounted within a frame, and methods of making the sound barrier.

In one aspect, the present invention comprises a sound barrier comprising:

a plurality of panels, each panel comprising a polymeric material and a plurality of reinforcing inserts encased within the polymeric material; and a frame comprising a plurality of posts positioned in spaced, parallel relationship and extending vertically upward, and defining inwardly-facing slots for receiving the panels;

wherein the panels are mounted lengthwise with ends within the slots and adjacent panels engage each other by tongues and grooves of lateral surfaces.

FIGS. 1 to 4 show some embodiments of a reinforced sound-absorbing panel (12). In some embodiments, the panel (12) has a substantially rectangular shape in a horizontal cross-section and in a vertical cross-section. In some embodiments, the panel (12) has a length ranging from about 8 feet to about 10 feet, a width ranging from about 1 foot to 2 feet, and a thickness ranging from about 2 inches to 3 inches. In some embodiments, the panel (12) has a weight ranging from about 60 lbs to about 240 lbs. In some embodiments, the panel (12) has a length of about 8 feet, a width of about 1 foot, a thickness of about 2 inches, and a weight of about 60 lbs. In some embodiments, the panel (12) has a length of about 10 feet, a width of about 2 feet, a thickness of about 3 inches, and a weight of about 240 lbs. In some embodiments, the color of the panel (12) may be selected from grey, black, redwood, brown, or terra-cotta. In some embodiments, the panel (12) may have different shapes, sizes, weights, and colors.

In some embodiments, the sound-absorbing panel (12) is comprised of two opposing upper and lower major surfaces (16, 18), two opposing end surfaces (20, 22), a first lateral surface (24), and a second lateral surface (26).

In some embodiments, the sound-absorbing panel (12) comprises reinforcing tongue and groove joints. In some embodiments, the first lateral surface (24) defines a tongue (28) extending along the entire length of the first lateral surface (24), and the second lateral surface (26) defines a groove (30) extending along the entire length of the second lateral surface (26). Provision of tongue and groove joints on the panels (12) facilitates stacking of adjacent panels (12) during installation, provides strength and reinforcement by eliminating or minimizing space between adjacent panels (12), and eliminates or minimizes leakage of noise through adjacent panels (12). The tongue (28) of a first panel (12) receives the grooves (30) of a second panel (12) stacked on top of the first panel (12). The tongue (28) of the second panel (12) receives the grooves (30) of a third panel (12) stacked upon the second panel (12), and so forth.

In some embodiments, the panel (12) may be constructed of a polymeric material. As used herein, the term "polymeric material" includes without limitation rubber materials (whether naturally existing, synthetic or a combination of naturally existing rubber and synthetic). In some embodiments, the polymeric material is rubber sourced from tires (e.g., styrene-butadiene rubber), which rubber is ground into particulate crumb form and may be mixed with secondary materials such as metal and textile fibers (e.g., fibers made of steel, aramid, polyester materials generated from crumb rubber production from tires), that are bound together using suitable binders known in the art, including without limitation, polyurea or polyurethane polymer binders that are cured under pressure. In some embodiments, the polymeric material comprises rubber sourced from tires which is ground into particulate crumb and bound using a polyurethane polymer binder. The particular crumb is typically sized by passing through a screen, with the size based on a dimension (inches) or mesh (holes per inch: 10, 20, etc.). In some embodiments, the size of the particulate crumb is 10.

Without being bound by any theory, rubber in particulate crumb form is highly resistant to environmental conditions and aging, may be obtained at low cost, and may allow sound to be better absorbed within the panel (12), as compared to a solid material from which sound would rebound rather than be absorbed.

Figure 9:
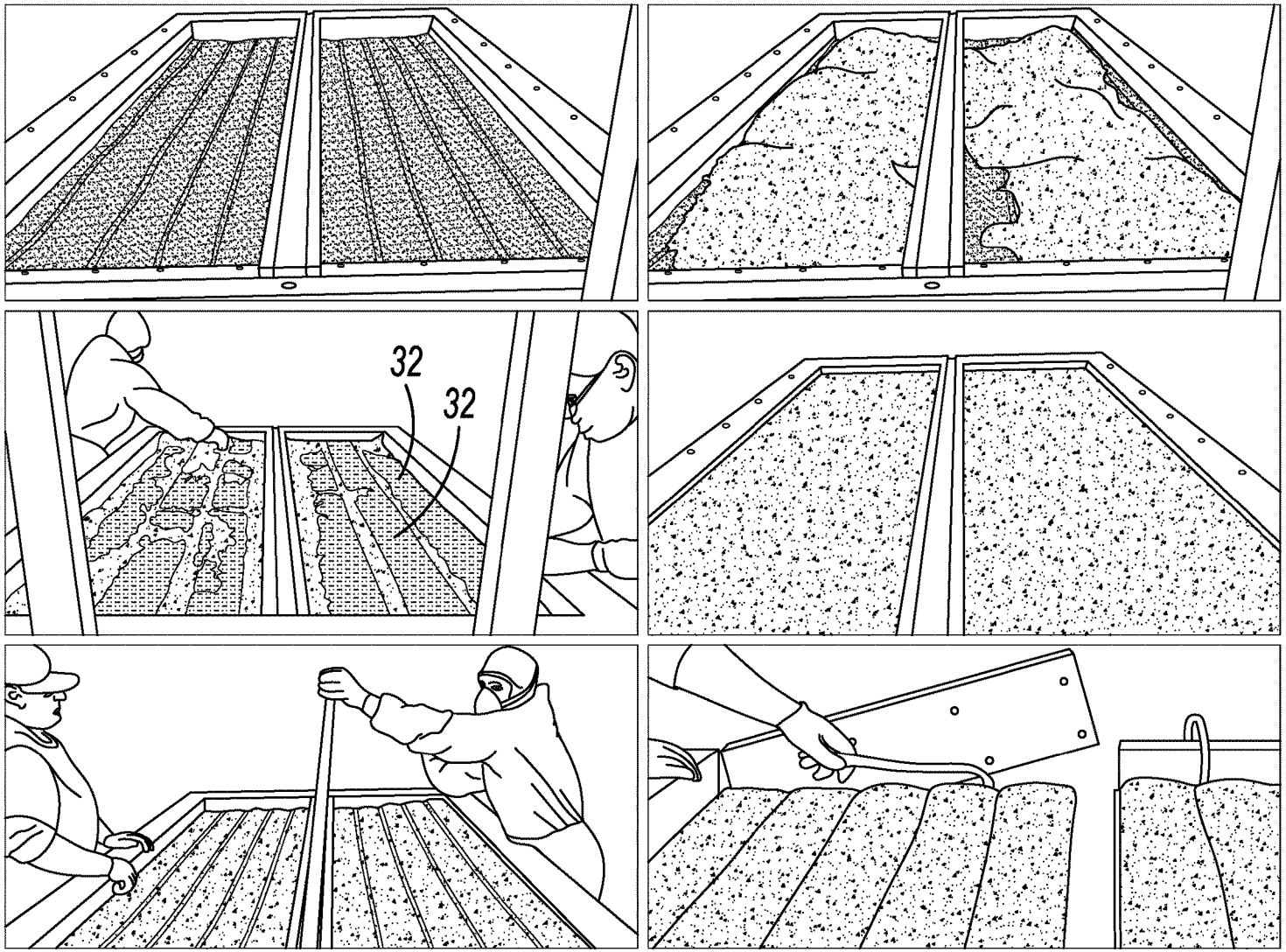
FIG. 9 show steps in the manufacturing of the sound-absorbing panel of FIG. 4.
Figure 10:
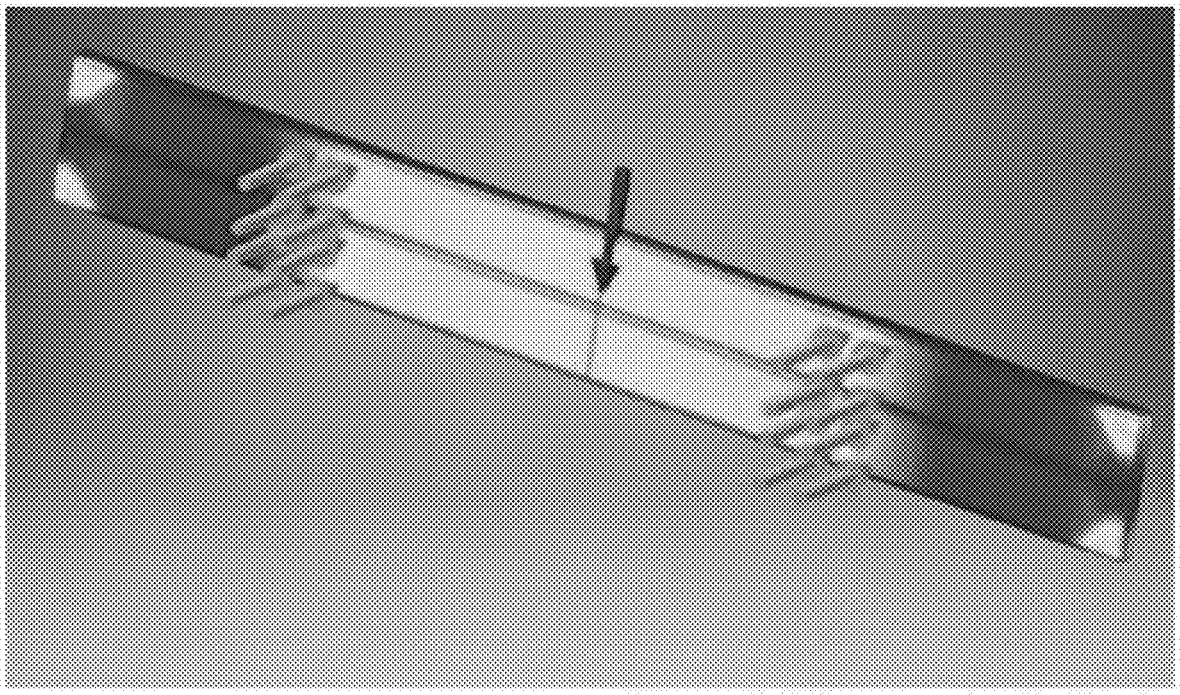
FIG. 10 shows results of a stress test conducted on the panel of FIG. 1.
Figure 11:
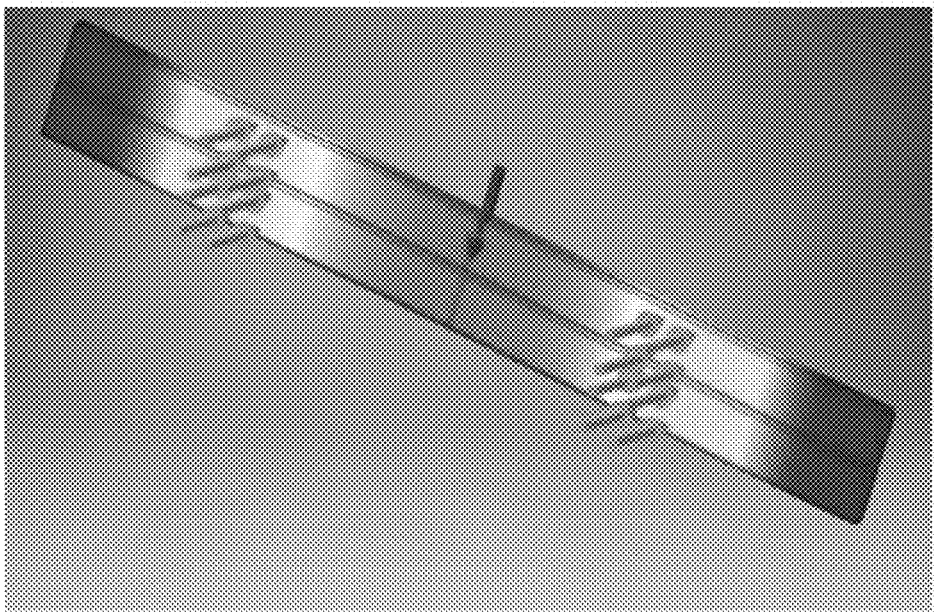
FIG. 11 shows results of a deflection test conducted on the panel of FIG. 1.
Figure 12:
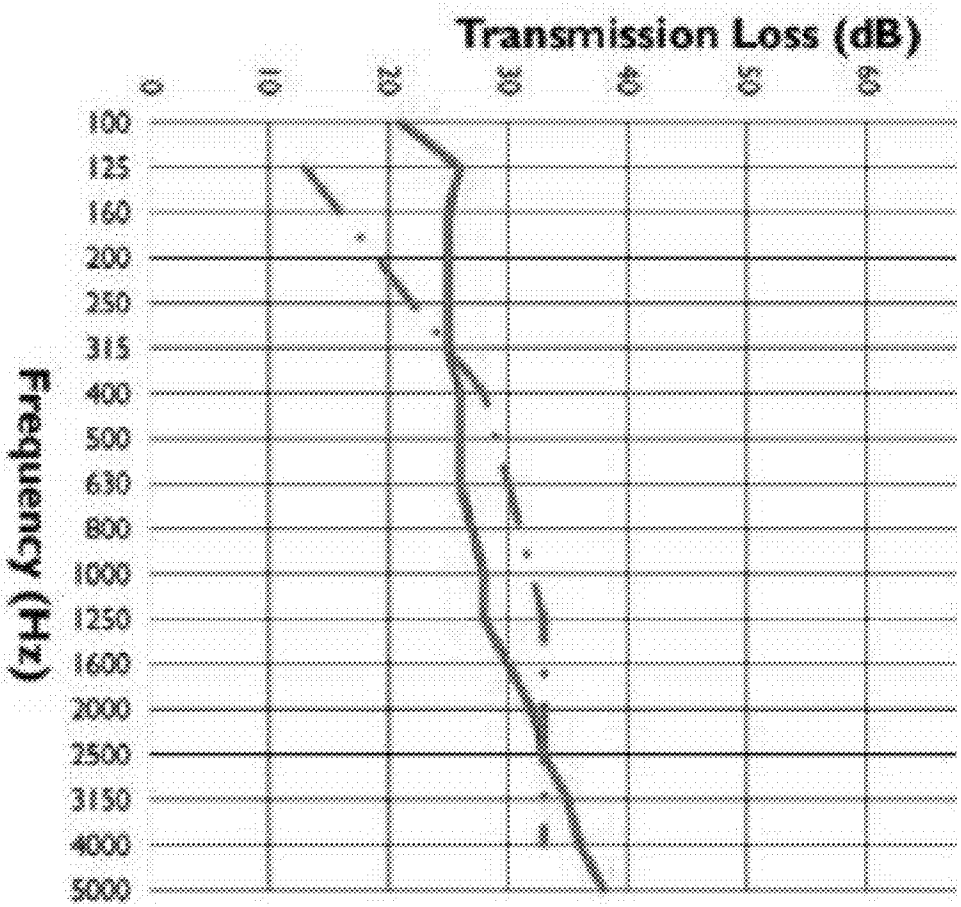
FIG. 12 is a graph showing transmission loss (dB) versus frequency (Hz) for the panel of FIG. 1.
Figure 13:
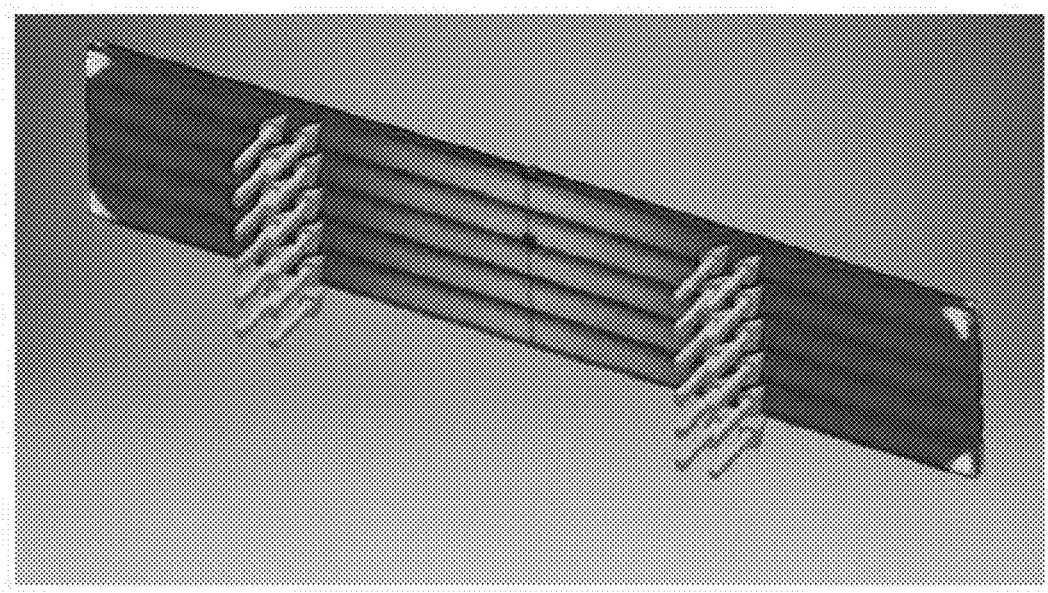
FIG. 13 shows results of a stress test conducted on the panel of FIG. 4.
Figure 14:
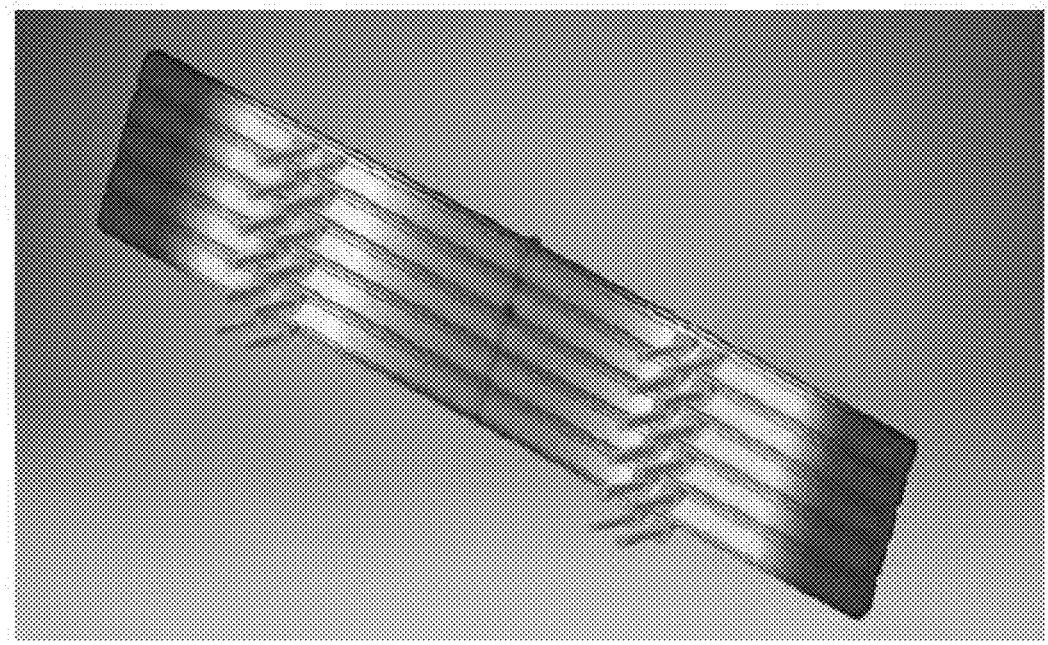
FIG. 14 shows results of a deflection test conducted on the panel of FIG. 4.
Figure 15:
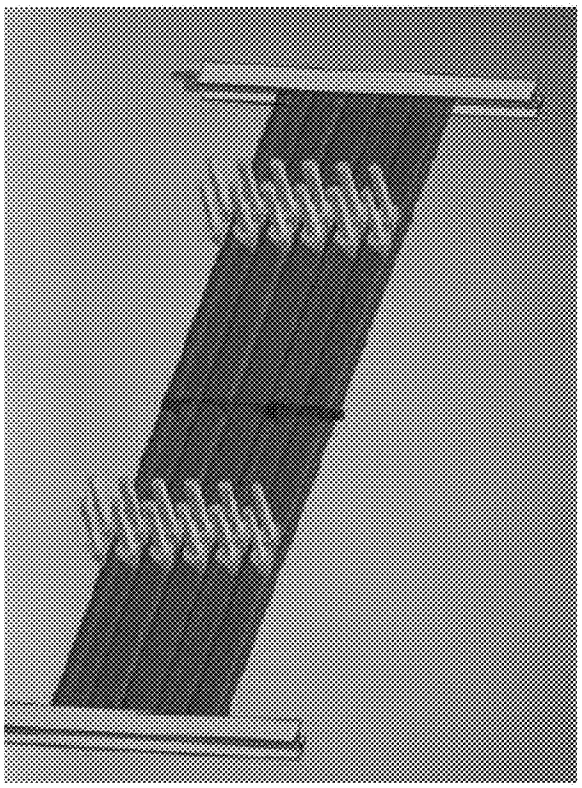
FIG. 15 shows results of finite element analysis conducted on the panel of FIG. 4.

In some embodiments, the panel (12) further comprises one or more reinforcing inserts (32) (FIG. 9). In some embodiments, the inserts (32) are encased within the panel (12). In some embodiments, the inserts (32) are oriented parallel to the opposing end surfaces (20, 22) and extend between the opposing end surfaces (20, 22) along the entire length or a portion thereof of the panel (12). Each insert (32) is spaced parallel and apart from adjacent inserts (32). In some embodiments, the inserts (32) are spaced apart at a distance ranging from about 2 to about 3 inches. In some embodiments, the insert (32) has a width of about 1 inch and a length of about 4 inches. In some embodiments, the inserts (32) are oriented perpendicular to the opposing end surfaces (20, 22) and extend between the opposing end surfaces (20, 22) along the entire length of the panel (12) (FIG. 9). In some embodiments, the insert (32) has a width of about 1 inch and a length ranging from about 8 feet to about 10 feet or a few inches less than the length of the panel (12) (FIG. 9).

In some embodiments, the insert (32) is formed of wood. In some embodiments, the insert (32) is formed of a composite material. In some embodiments, the inserts (32) may be formed of any suitable material known in the art that has sufficient strength and rigidity for use in the panel (12) for a desired application.

Without being bound by any theory, the inserts (32) confer support, stiffness, stability, and lateral strength to the panel (12) in the vertical direction, since a panel (12) formed of rubber alone has less structural strength and may be prone to warping. The spacing apart of the inserts (32) in combination with the use of the polymeric material confers a small amount of flex to the panel (12) if the panel (12) is to be curved, and allows the panel (12) to yield when impacted by an object such as, for example, a vehicle crashing into the sound barrier (1), or to withstand high wind-loads. The inserts (32) may also help absorb sound waves.

Figure 5:
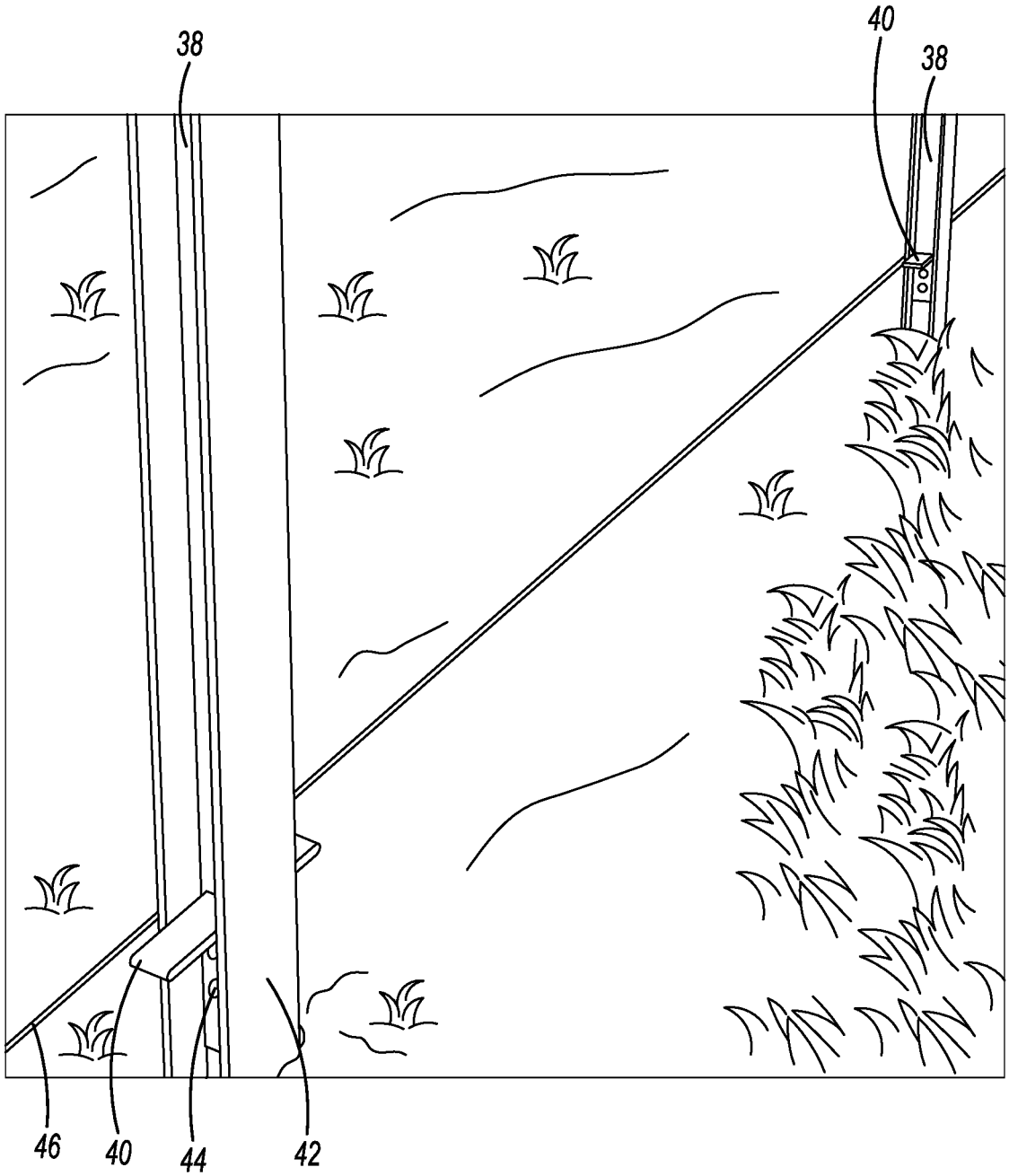
FIG. 5 is a side perspective view of a first embodiment of a frame for use in mounting multiple panels of FIG. 1 or FIG. 4 to form the sound barrier.
Figure 6:
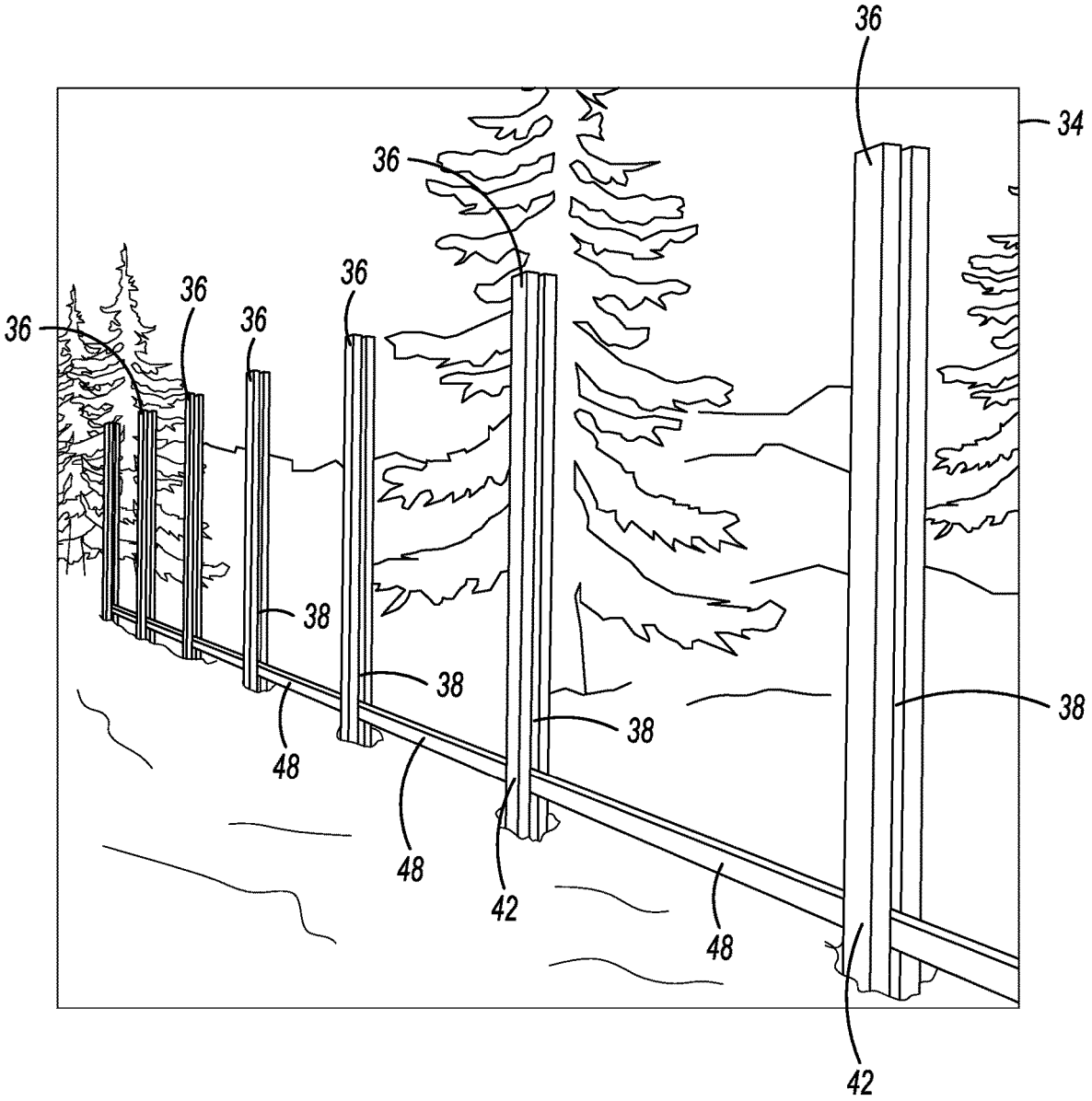
FIG. 6 is a side perspective view of a second embodiment of a frame for use in mounting multiple sound-absorbing panels of FIG. 1 or FIG. 4 to form the sound barrier.

The sound barrier (1) is assembled by mounting or stacking individual panels (12) within a frame (34) (FIGS. 5 and 6). In some embodiments, the frame (34) comprises posts (36). In some embodiments, a plurality of posts (36) is repeated to provide a "fence-like" sound barrier (1) of any desired length once the panels (12) have been mounted. At a desired location, the posts (36) are erected in the ground in spaced, parallel relationship and extend vertically upward from the ground.

In some embodiments, the posts (36) define inwardly-facing slots (38) extending along the entire length of the posts (36). In some embodiments, the posts (36) define an "H-beam" in cross-section to provide a pair of slots (38). In some embodiments shown in FIG. 5, "L"-shaped brackets (40) are secured within the slots (38) of the posts (36) at their bases (42) in proximity to the ground, and support the panels (12) above the ground once the panels (12) have been mounted within the frame (34). Suitable attachment means (44) for securing the "L"-shaped brackets (40) within the slots (38) include, but are not limited to, bolts, screws, pins, rivets, nails, or other type of fasteners. During installation, bracketing the posts (36) also ensures that the posts (36) stay level while the cement is setting. A level line (46) (from the first post to the last post) is plumbed at the lowest level possible to the ground, and the "L"-shaped brackets (40) are installed at the level line (46). It is suggested to ensure that this line (46) is level since it is noticeable if it is uneven when the panels (12) are installed.

In some embodiments shown in FIG. 6, the frame (30) comprises the posts (36) and a cross-beam (48). In some embodiments, the cross-beam (48) is received within the slots (38) of the posts (36) by sliding the cross-beam (48) from above into the slots (38). The cross-beam (48) seats against the "L"-shaped brackets (40) so as to be oriented perpendicularly to the posts (36) and extends horizontally between the posts (36). In some embodiments, the cross-beam (48) has a length which is substantially the same as the length of the panels (12). The cross-beam (48) supports the panels (12) above the ground once the panels (12) have been mounted within the frame (34). The cross-beam (48) may be included optionally as a part of the frame (34) to provide a decorative or aesthetically-pleasing look to the sound barrier (1).

In some embodiments, the panels (12) are mounted within the frame (34) using a tongue and groove joint construction in order to facilitate installation manually or without requiring heavy equipment, and to provide strength to the panels (12). In some embodiments, the opposed end surfaces (20, 22) of the panels (12) are profiled so that a tongue-and-groove joint is formed between the opposed end surfaces (20, 22) of the panels (12) and the slots (38) of the posts (36). The opposed end surfaces (20, 22) of the panels (12) are received within the slots (38) by sliding the panels (12) from above into the slots (38). The slots (38) support the panels (12) along the entire end surfaces (20, 22) of the panels (12).

Figure 7:
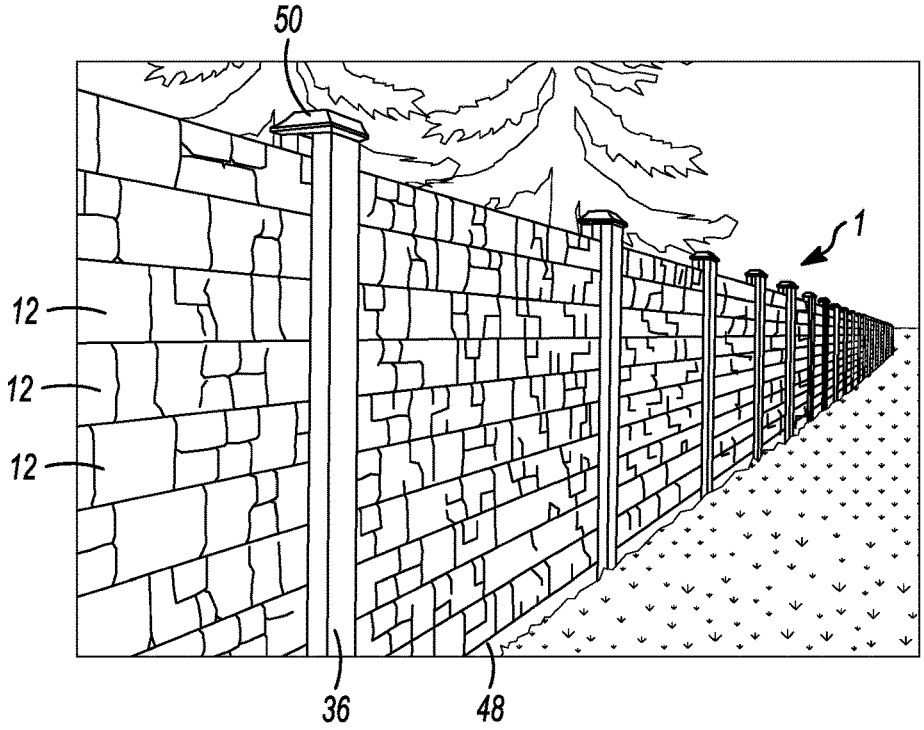
FIG. 7 is a side perspective view of multiple sound-absorbing panels of FIG. 1 mounted within a frame to form the sound barrier.
Figure 8:
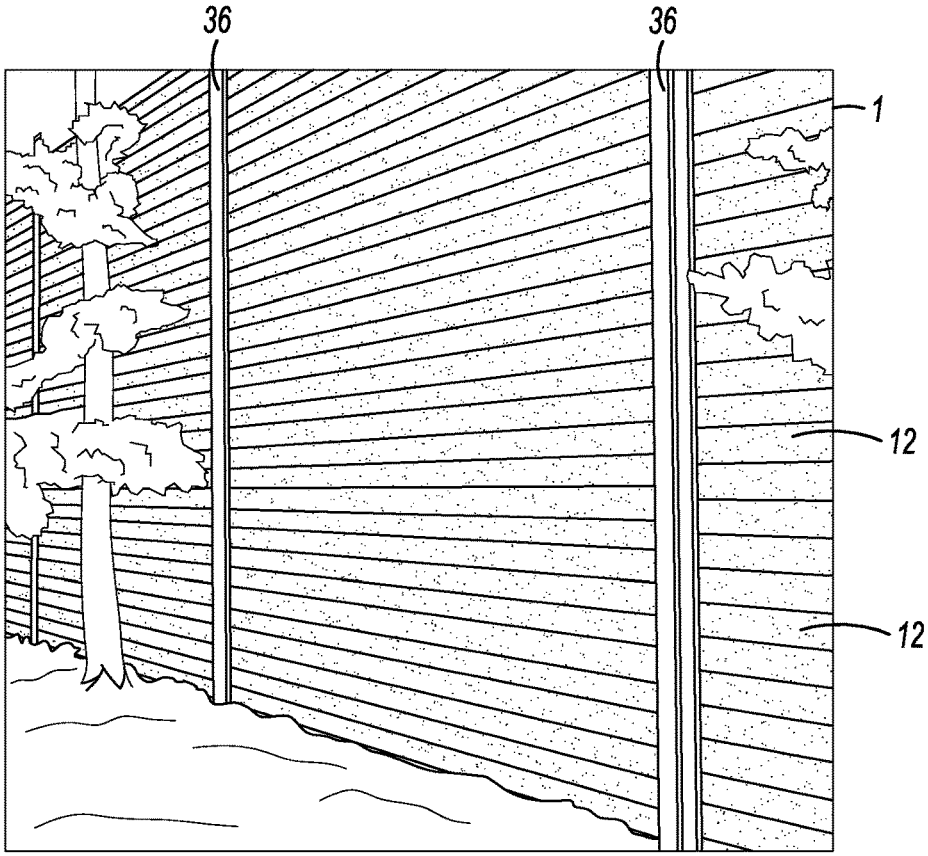
FIG. 8 is a side perspective view of multiple sound-absorbing panels of FIG. 4 mounted within a frame to form the sound barrier.

The panels (12) are mounted lengthwise, such that adjacent panels (12) engage with each other by their lateral surfaces (24, 26) (FIGS. 7 and 8). In some embodiments, adjacent panels (12) engage with each other by the reinforcing tongue (28) and groove (30) joints of their lateral surfaces (24, 26). In this manner, the panels (12) may be stacked to the desired height required by the user. In some embodiments, six panels (12) may be stacked to provide a barrier having a length of about 8 feet and a height of about 6 feet. In some embodiments, post caps (50) may be attached to the tops of the posts (36) to provide decoration, lighting, and protection from decay, weather, birds, and insects (FIG. 7). Suitable post caps (50) may be formed of metal, glass, wood, or other materials, or may include solar lights.

The panels (12) can be easily removed to allow repair, replacement, or relocation by sliding the panels (12) upwardly from within the slots (38). It will be understood by those skilled in the art that if desired, the panels (12) can be permanently attached to each other by applying adhesives or other materials to the lateral surfaces (24, 26) of adjacent panels (12).

In another aspect, the present invention comprises a method for producing a sound barrier comprising the steps of:

a) forming a plurality of panels, each panel comprising a polymeric material and a plurality of reinforcing inserts encased within the polymeric material; and b) forming a frame comprising a plurality of posts defining inwardly-facing slots for receiving the panels.

As shown in FIG. 9, an initial portion of the polymeric material and a curable binder is placed in a mold. In some embodiments, the polymeric material comprises crumb rubber from recycled tires. In some embodiments, the polymeric material may further comprise tire-derived fiber from recycled tires. In some embodiments, the binder is selected from polyurea, or polyurethane polymer. In some embodiments, the mold shapes the panel (12) to form the lower major surface (18) of the panel (12). The inserts (32) are then placed spaced apart into the mold. By spacing the inserts (32) apart, the seams of the panel (12) may settle and close tightly without gaps. An additional portion of the polymeric material is placed into the mold over the inserts (32). The particle sizes of the crumb rubber should be sufficiently small so that the particles can fill the spaces between the inserts (32). The particles are lightly compressed.

The curable binder is then allowed to cure while subjecting the polymeric material to pressure inside the mold to form the panel (12), as a monolithic unit that encases the inserts (32), with the inserts (32) being encased between the upper major surface (16) and the lower major surface (18), namely within the center along the length of the panel (12). In some embodiments, the polymeric material and binder are compressed at a shore hardness ranging from about 55 to about 63. In some embodiments, the polymeric material and binder are compressed at a shore hardness of about 55. This may yield a panel (12) which may allow sound to penetrate the polymeric material and to be captured within the panel (12). One or both of the upper and lower major surfaces (16, 18) may be profiled as smooth or textured surfaces. In some embodiments shown in FIGS. 1-4 and 7-8, both the upper and lower major surfaces (16, 18) are textured as a brick-like mosaic or stone pattern to be visually appealing, thereby preserving aesthetics and scenic vistas. The dual-formed texture provides higher community acceptance. Further, the brick-like mosaic or stone pattern may also redirect the sound waves.

The frame (34) can be constructed from any material or combination of materials having suitable properties such as, for example, mechanical strength; rigidity; ability to withstand rusting, warping, cold and adverse outdoor conditions; and ease of machining. In some embodiments, the posts (36) and cross-beam (48) are formed of materials including, but not limited to, wood, metal (such as, for example, aluminum, steel, etc.) and the like. In some embodiments, the selected material is aluminum to avoid rusting or warping. In some embodiments, the posts (36) can be powder coated to match the panels (12). In some embodiments, the "L"-shaped brackets (40) are formed of heavy duty industrial metals including, but not limited to, steel and iron, to confer strength and support the weight of multiple panels (12).

The dimensions are not essential to the invention and may be increased or decreased as may be required to satisfy any particular design objectives; for example, the panels (12) and frame (34) may be available in a variety of dimensions.

Without being bound to any theory, it is believed that the sound barrier (1) exhibits enhanced strength, resiliency, and sound attenuation properties due to the construction of the reinforced sound-absorbing panels (12). When mounted within the frame (34), the panels (12) may effectively absorb sound (meaning less noise pollution) due to the lightly compressed particles of crumb rubber from which it has been formed, but also provide strength and resiliency due to the inserts encased within the panels (12) to protect the sound barrier (1) from various factors such as, for example, adverse environmental conditions or physical impacts from objects such as crashing vehicles. The panels (12) do not fade (i.e., UV protective), crack, peel, rot, or decay, and are fire rated. Any graffiti may be power washed off the panels (12). Further, the sound barrier (1) provides versatility and can be readily assembled due to being lightweight with minimal effort for manual labor or installation hardware such as heavy equipment. The sound barrier (1) is inexpensive to manufacture and is cost effective compared to cedar or concrete privacy walls. The sound barrier (1) protects the environment by recycling materials, particularly rubber sourced from tires, making the sound barrier (1) a durable, long-lasting solution to environmental problems.

The sound barrier (1) of the present invention may be used in a variety of applications including, but not limited to, reducing noise outdoors in highway, residential, commercial, industrial, and construction areas. For example, the sound barrier (1) may be used in high traffic locations, reducing the sound levels by about 40%. The sound barrier (1) may be used to screen off residential areas from sources of noise such as heavy traffic, high speed freeways, construction zones, factories, manufacturing sites, hospitals, airports, railroads, and the like; as an enclosure around patios; as a privacy wall between homes and apartments; and as a security fence or a windbreak. The sound barrier (1) may screen and protect commercial property, allowing shopping centers and institutions to be compatibly located near residential areas; and screen industrial operations from nearby landowners. It will be understood by those skilled in the art that if desired, the sound barrier (1) may be used indoors in offices, sports facilities, schools, shopping malls, etc. to reduce the level of noise.

During development of the invention, the inventors subjected embodiments of the sound barrier (1) to one or more of wind, noise, and fire element analyses (see Examples 1 and 2). The panels (12) of these embodiments were manufactured to differ in size, weight, and density. The test results are set out in Tables 1 and 2 and shown in FIGS. 10-15.

As used herein, the term "sound transmission class (STC)" refers to an integer rating which reflects the ability of a sound barrier to attenuate airborne sound. In some embodiments, the sound transmission class of the sound barrier (1) may be about 29. The sound barrier (1) is thus capable of reducing noise by about 29 decibels which is relatively high. In some embodiments, the sound transmission class of the sound barrier (1) may be about 37. In some embodiments, the sound barrier (1) is thus capable of substantially reducing noise by about 29 or about 37 decibels. As used herein, the term "noise reduction coefficient" refers to a logarithmic representation of the decay rate (dB/s) due to a sound barrier with a defined surface area absorbing energy compared to the decay rate in a standard reverberant room without the sound barrier. In some embodiments, the noise reduction coefficient is at least about 0.30, meaning that at least about 30% of the sound energy coming into contact with the sound barrier (1) is absorbed. The sound barrier (1) having a noise reduction coefficient of 0.30 would also be considered 70% reflective. In some embodiments, the noise reduction coefficient of the sound barrier (1) may be at least about 0.40, meaning that about 40% of the sound energy coming into contact with the sound barrier (1) is absorbed. The sound barrier (1) having a noise reduction coefficient of 0.40 would also be considered 60% reflective.

Without being bound by any theory, these unique properties of the sound barrier (1) may be attributed to its structure, namely the panels (12) having reinforcing inserts (32) therein and the density hardness resulting from compression of relatively fine particulate crumb, particularly rubber sourced from tires. The fineness of the particulate crumb may contribute to the absorption of sound.

Embodiments of the present invention are described in the following Examples, which are set forth to aid in the understanding of the invention, and should not be construed to limit in any way the scope of the invention as defined in the claims which follow thereafter.

Example 1—First Embodiment of the Sound Barrier

In a first embodiment of the sound barrier, each panel of the sound barrier was manufactured to have a length of 8 feet, a width of 1 foot, a thickness of 2 inches, and a weight of 60 lbs. These dimensions of the panel allow for less post work to accommodate the 8 feet span. Panels were subjected to wind, noise, and fire element analyses in a laboratory, with the results set out in Table 1 and shown in FIGS. 10-12.

TABLE 1

| Test | Result |
|---|---|
| ASTM E162 | Surface flammability flame spread index 110 at average temperature rise of 157.7° C. Material meets ANSI Z124.1 and Z124.2 Appendix III requirement for an average DM of 450 or less. Self-extinguished. |
| ASTM C 503 tested | Wear index 270 (using heavy duty abrading wheels and 100 grams pressure on each wheel at 1000 cycles). Recycled rubber crumb from tires and urethane resin binder. |
| Density Hardness ASTM 2240 | Shore A 63, compressed to 2000 psi |
| Coefficient of Friction ASTM C 1028 | 0.92-0.96 dry and 0.89-0.92 wet |
| Static Dissipation | Negligible |
| Skid Resistance ASTM 303 | Average 66 dry and 43 wet |
| ASTM B117 | No stain or residue after 24 hour test |
| Xenon Arc Weathering-200 hours UV testing | No change after 2 years. Urethane binder UV inhibitors |
| Structural Compression | 2000 PSI |
| Thermal Resistance | R value of 2.20 per 1 inch of thickness. (i.e.) 2 inch thick tile provides R-Value rating of 4.40. |
| Wind Loading and Direct Load | 70 mph/112 km/h. 120 lbs/54.4 kg. |
| Transmission Lost | 25+ dB |

TABLE 1-continued

| Test | Result |
|---|---|
| Sound Transmission Class (STC) | 29 |
| ASTM E84-19A | Flame spread index-185. Smoke developed index-2050. |
| CA/ULC S102.2-18 | Flame spread rating-110. Smoke developed classification-535. |
| Surface Density | 36.62 kg/m$^2$-7.50 lbs/ft$^2$ |

During installation at a site, post holes were initially dug into the ground. The posts were set using 8 feet plus ½ inch spacers between adjacent posts. With the panels having a length of 8 feet, the extra ½ inch allows for any expansion that may occur in high temperatures with the polymeric material (e.g., rubber). The post holes were filled with concrete, the posts were centered and levelled, and the cement was left to set. It is suggested to bracket the posts while the cement sets to ensure that the posts stay level. A level line (from the first post to the last post) was plumbed at the lowest level possible, and L-brackets were installed at this lowest line. It is suggested to ensure that this line is level since it is noticeable if it is uneven when the cross-beam (if any) and panels are installed.

The panels were installed (groove on bottom, tongue on top) by sliding the panels from above downwards into the slots of the posts. Once each panel was installed, the subsequent panel was rotated to ensure that the pattern did not run the same as the panel previously installed below. The tongue of the first panel received the grooves of the second panel stacked on top of the first panel. The tongue of the second panel received the grooves of the third panel stacked upon the second panel, and so forth. In this manner, multiple panels were eventually stacked to form a sound barrier section of the desired height. The number of panels needed to form a sound barrier section may be easily calculated by dividing the desired height of the sound barrier wall by the width of each panel (for example, to form a sound barrier section having a final total height of 6 feet and with each panel being 1 foot in width, six panels were stacked). Calculation of the final total height is important in the event that a second level line is also being plumbed at the highest level possible to line up the top of the posts. Otherwise, if the installer has portions of posts sticking up higher than desired, he can simply trim them down to the desired height after the panels have been installed with a skill saw; however, trimming the post tops would remove the powder coating from the top of the posts.

The entire installation process was found to be rapid. There were no screws to fasten and no heavy equipment required, with the exception of a skid steer to move the skids of materials. Since each panel weighed only 60 lbs, a crew of only one or two people were able to lift and set the panels in place within the posts. Once the posts were in place, the installation of a wall formed of sound barrier sections and having a total length of 450 feet was completed by a crew of eight people under an hour (i.e., 55 minutes).

Example 2—Second Embodiment of the Sound Barrier

In a second embodiment of the sound barrier, each panel of the sound barrier was manufactured to have a length of 10 feet, a width of 2 feet, a thickness of 3 inches, and a weight of 240 lbs. An acoustic study was conducted to investigate if the panel having a thickness of 3 inches might be sufficient for utilization as a sound barrier, and to compare transmission loss of the panel to common sound barriers constructed from concrete, wood, steel, and other materials. The study was not to concentrate on the actual physical height of the sound barrier, but rather to focus on the ability of the panel to reflect and absorb sound energy. One of the most important parameters of the sound barrier is the transmission loss. When sound is striking a barrier, it will be partially reflected, and also partially absorbed. The remaining sound energy will then be transmitted through. The goal is to minimize or completely remove this transmission component. The results of these analyses are set out in Table 2 and shown in FIGS. 13-15:

TABLE 2

| Test | Result |
|---|---|
| Wind Loading and Direct Load | 90 mph/144 km/h. 350 lbs/158 kg. |
| Transmission Lost | 35+ dB |
| Sound Transmission Class (STC) | 37 |
| Surface Density | 58.59 kg/m$^2$-12.00 lbs/ft$^2$ |

During installation at a site, post holes were initially dug into the ground. The posts were set using 10 feet plus ½ inch spacers between adjacent posts. With the panels having a length of 10 feet, the extra ½ inch allows for any expansion that may occur in high temperatures with the polymeric material (e.g., rubber). The post holes were filled with concrete, the posts were centered and levelled, and the cement was left to set. It is suggested to bracket the posts while the cement sets to ensure that the posts stay level. A level line (from the first post to the last post) was plumbed at the lowest level possible, and L-brackets were installed at this lowest line. It is suggested to ensure that this line is level since it is noticeable if it is uneven when the cross-beam (if any) and panels are installed.

Each panel was strapped upright on the forks of the lifting device (for example, a forklift, loader, etc.) and lifted until the bottom of the panel reached the top of the post. The panels were installed (groove on bottom, tongue on top) by sliding the panels from above downwards into the slots of the posts. Once each panel was installed, the subsequent panel was rotated to ensure that the pattern did not run the same as the panel previously installed below. The tongue of the first panel received the grooves of the second panel stacked on top of the first panel. The tongue of the second panel received the grooves of the third panel stacked upon the second panel, and so forth. In this manner, multiple panels were eventually stacked to form a sound barrier section of the desired height for the purpose of reducing road noise along a major highway.

The present invention has been described above and shown in the drawings by way of exemplary embodiments and uses, having regard to the accompanying drawings. The exemplary embodiments and uses are intended to be illustrative of the present invention. It is not necessary for a particular feature of a particular embodiment to be used exclusively with that particular exemplary embodiment. Instead, any of the features described above and/or depicted in the drawings can be combined with any of the exemplary embodiments, in addition to or in substitution for any of the other features of those exemplary embodiments. One exemplary embodiment's features are not mutually exclusive to another exemplary embodiment's features. Instead, the scope of this disclosure encompasses any combination of any of the features. Further, it is not necessary for all features of an exemplary embodiment to be used. Instead, any of the features described above can be used, without any other particular feature or features also being used. Accordingly, various changes and modifications can be made to the exemplary embodiments and uses without departing from the scope of the invention as defined in the claims that follow.

The embodiments of the invention in which an exclusive property or privilege is claimed are defined as follows:

1. A sound barrier comprising:

a plurality of panels, each panel comprising rubber from recycled tires or tire-derived fiber from recycled tires in the form of particulate crumb sized to confer density hardness to the panels; and a plurality of reinforcing inserts formed of wood or a composite material extending along an entire length or a portion thereof of the panel, and encased within the rubber; and a frame comprising a plurality of posts positioned in spaced, parallel relationship and extending vertically upward, and defining inwardly-facing slots for receiving the panels; wherein the panels are mounted lengthwise with ends within the slots and adjacent panels engage each other by tongues and grooves of lateral surfaces.

2. The barrier of claim 1, wherein the panel has a substantially rectangular shape comprising opposing upper and lower major surfaces textured in the form of a brick-like mosaic or stone pattern; opposing end surfaces configured for insertion into the slots of the posts; a first lateral surface defining a tongue extending along a length of the first lateral surface; and a second lateral surface defining a groove extending along a length of the second lateral surface.

3. The barrier of claim 2, wherein the reinforcing inserts are oriented to extend between the opposing end surfaces along the entire length or the portion thereof of the panel, each insert being spaced parallel and apart from adjacent inserts.

4. The barrier of claim 1, further comprising a plurality of brackets secured within the slots at bases of the posts for supporting the panels above ground.

5. The barrier of claim 4, further comprising a cross-beam received within the slots of the posts and seating against the brackets, the cross-beam being oriented perpendicularly to bases of the posts and extending horizontally between the posts for supporting the panels thereabove.

6. The barrier of claim 1, having a density hardness ranging from about 55 to about 63; a sound transmission class ranging between about 29 to about 37; and a noise reduction coefficient of at least 0.30.

7. A method for producing a sound barrier comprising the steps of:

a) forming a plurality of panels, each panel comprising crumb rubber from recycled tires, or tire-derived fiber from recycled tires and a plurality of reinforcing inserts formed of wood or a composite material encased within the crumb rubber; and b) forming a frame comprising a plurality of posts defining inwardly-facing slots for receiving the panels.

8. The method of claim 7, wherein each panel is formed by:

i) placing a first portion of the crumb rubber and a binder into a mold having a configuration of the panel, wherein the panel has a substantially rectangular shape comprising opposing upper and lower major surfaces textured in the form of a brick-like mosaic or stone pattern; opposing end surfaces configured for insertion into the slots of the posts; a first lateral surface defining a tongue extending along a length of the first lateral surface; and a second lateral surface defining a groove extending along a length of the second lateral surface;

ii) orienting reinforcing inserts to extend between the opposing end surfaces along an entire length or a portion thereof of the panel, each insert being spaced parallel and apart from adjacent inserts;

iii) encasing the reinforcing inserts with a second portion of the crumb rubber and the binder;

iv) allowing the binder to cure while subjecting the crumb rubber to pressure inside the mold.

9. The method of claim 8, wherein the binder is selected from polyurea or polyurethane polymer.

10. The method of claim 8, comprising subjecting the crumb rubber to sufficient pressure inside the mold to yield a density hardness ranging from about 55 to about 63.

11. The method of claim 8, further comprising securing a plurality of brackets within the slots at bases of the posts for supporting the panels above ground.

12. The method of claim 11, further comprising inserting a cross-beam within the slots of the posts and seating the cross-beam against the brackets, the cross-beam being oriented perpendicularly to bases of the posts and extending horizontally between the posts for supporting the panels thereabove.

* * * * *